United States Patent [19]

Turner

[11] Patent Number: 4,656,486

[45] Date of Patent: Apr. 7, 1987

[54] SATELLITE TV DISH ANTENNA SUPPORT

[76] Inventor: Allan L. Turner, 303 N. Davis St., Tehachapi, Calif. 93561

[21] Appl. No.: 754,414

[22] Filed: Jul. 12, 1985

[51] Int. Cl.[4] ..... H01Q 1/08

[52] U.S. Cl. ..... 343/882; 343/915

[58] Field of Search ..... 343/882, 880, 878, 840, 343/915, 878

[56] References Cited

U.S. PATENT DOCUMENTS

| | | | |
|---|---|---|---|
| 3,940,771 | 2/1976 | Wild | 343/882 X |
| 4,251,819 | 2/1981 | Vickland | 343/882 |
| 4,360,182 | 11/1982 | Titus | 248/371 |
| 4,379,297 | 4/1983 | Chevallier | 343/882 |
| 4,404,565 | 9/1983 | Gurney et al. | 343/882 X |
| 4,528,569 | 7/1985 | Felter et al. | 343/882 X |

*Primary Examiner*—Daniel M. Yasich

*Attorney, Agent, or Firm*—Allan M. Shapiro

[57] ABSTRACT

A television dish antenna which is directed toward the geosynchronous satellite orbit must be properly supported so that the antenna dish maintains position for satisfactory television viewing. In addition, the disc must be moved in the proper path so that it may be pointed at other geosynchronous satellites. The dish supporting structure includes a base frame which can be secured to a horizontal surface. The base provides a strong support for pivot bearings carried thereon which permit dish antenna motion along the correct path.

13 Claims, 9 Drawing Figures

FIG. 1
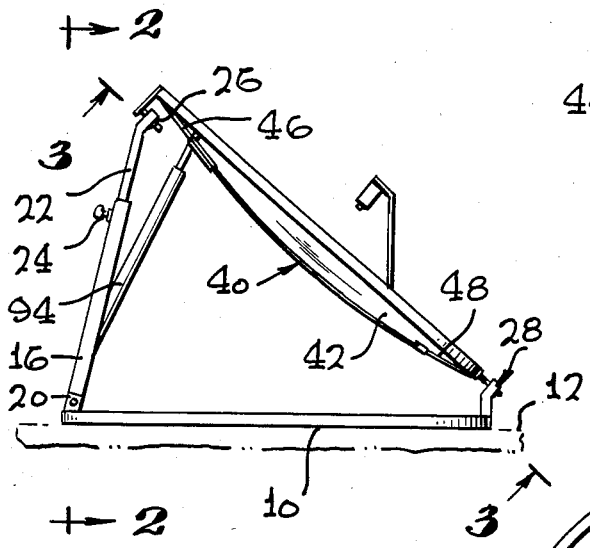
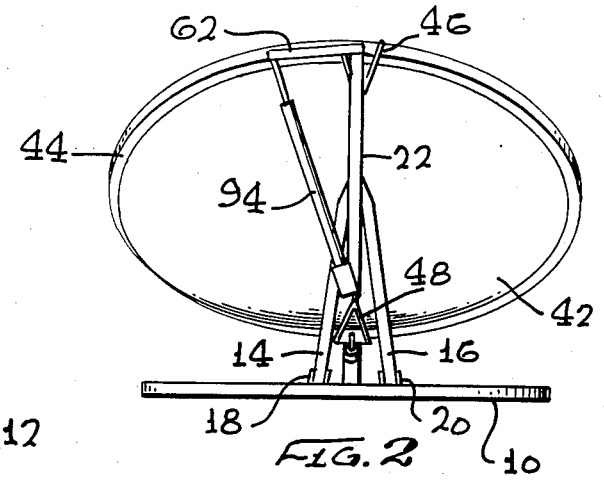
FIG. 2
FIG. 3
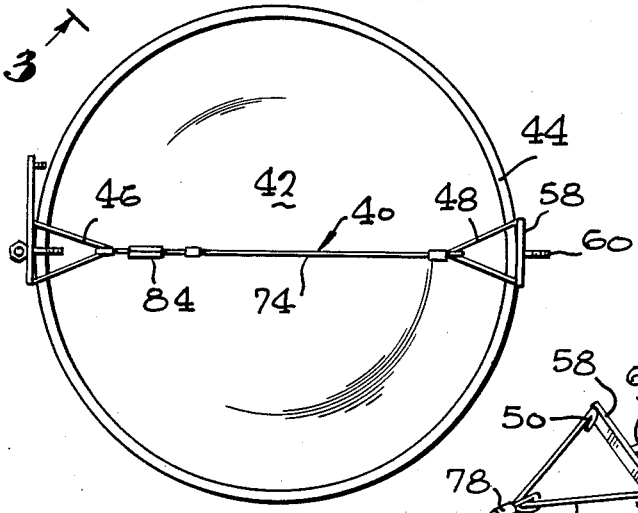
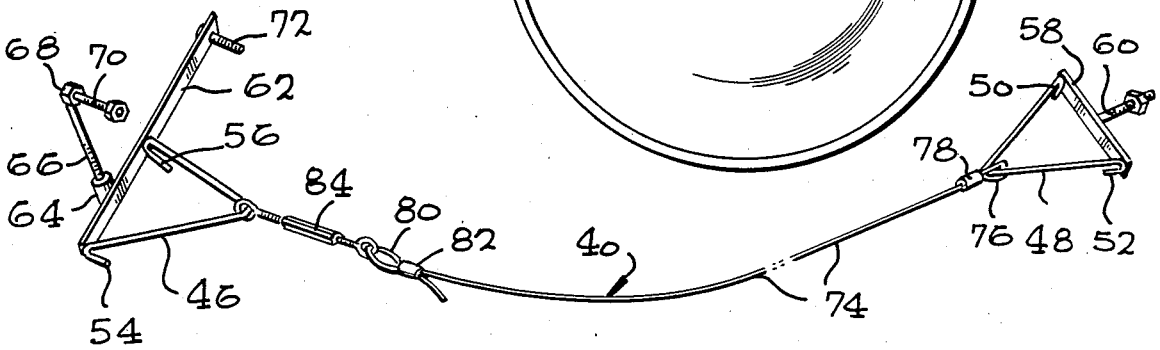
FIG. 4
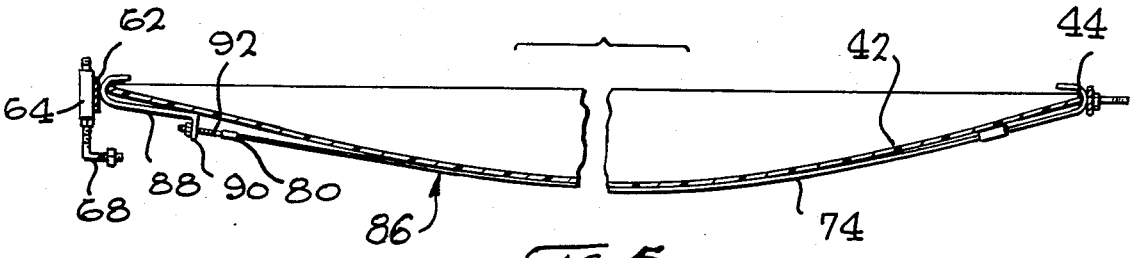
FIG. 5

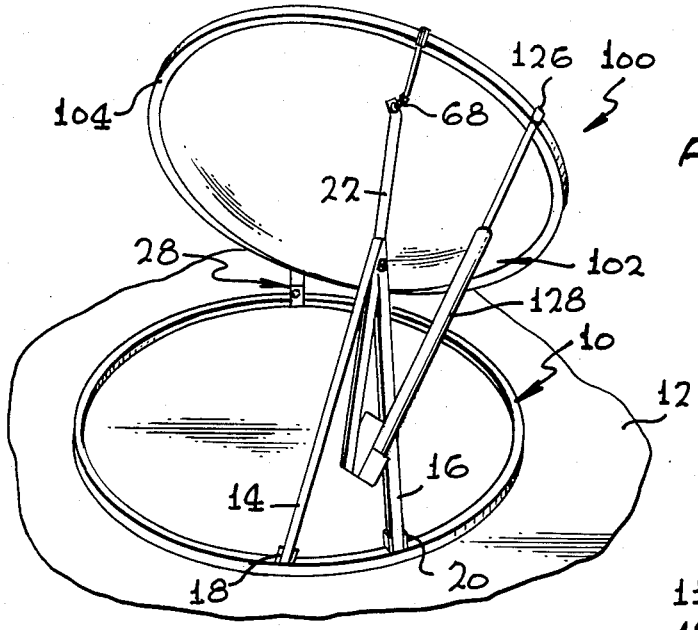
FIG. 6
FIG. 9
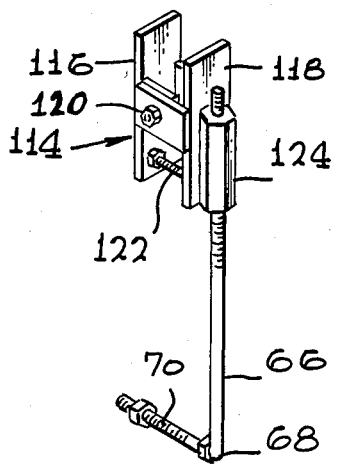
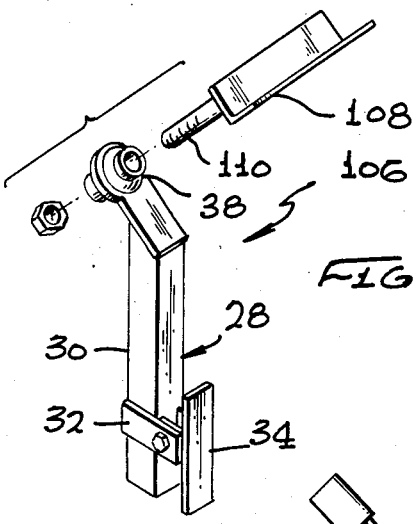
FIG. 8
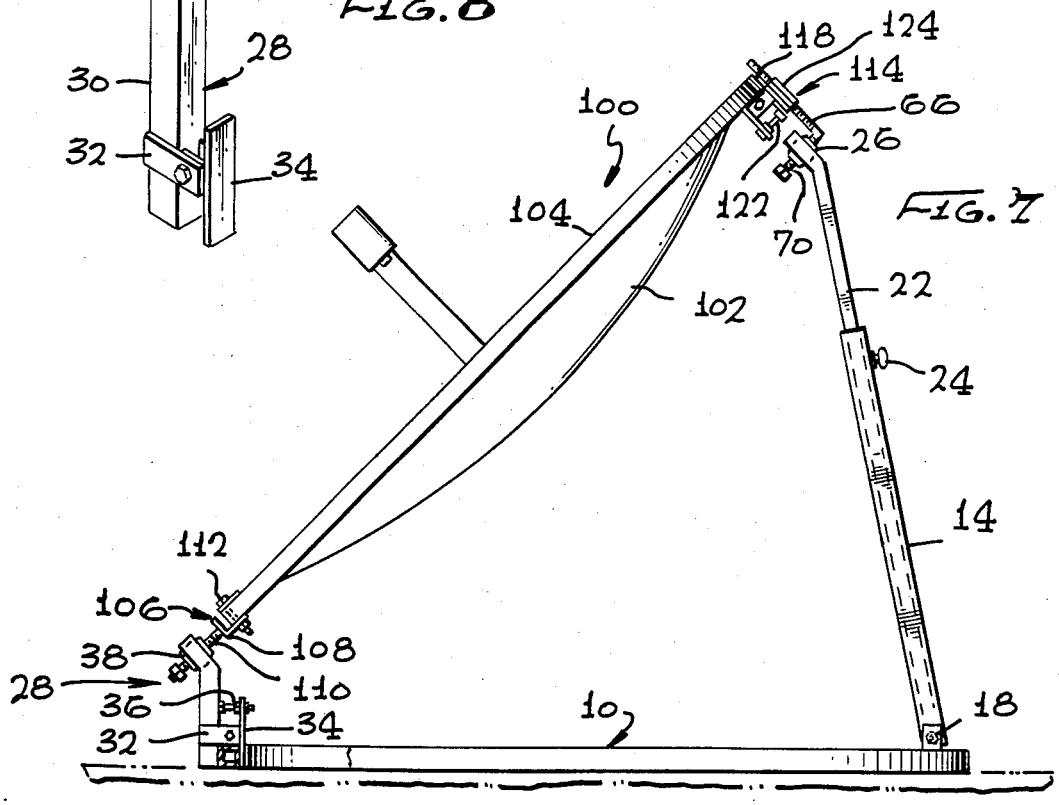
FIG. 7

SATELLITE TV DISH ANTENNA SUPPORT

BACKGROUND OF THE INVENTION

This invention is directed to the supporting structure for a satellite TV dish antenna, including base mounting, pivots and attachment to the periphery of the dish antanna.

Some satellites in geosynchronous orbit transmit signals which are entertaining and/or useful to many members of the general populace. In particular, television entertainment signals are broadcast, often for rebroadcast by terrestrial stations. In those parts of the United States where population is sparse, often there is not a full complement of television entertainment broadcasts. Even in urban areas, there are usually more television channels available from satellite broadcasts than there are available from terrestrial transmitters. Therefore, a considerable market has grown for receiving the statellite signals and converting them to household television frequencies.

Two principal structural elements are required. Electronically, a down converter is necessary to change frequency from the satellite broadcast frequencies to the home television set channel frequencies. Another important part of the system is the antenna. A dish having a diameter of about 5 feet is necessary to receive the signal. The dish must be properly supported to be accurately directed to the satellite position. Such support is complicated by the fact that there is a plurality of such satellites in the geosynchronous orbit, and to receive signals from the full complement of satellites, it is necessary to reposition the antenna. Polar antenna mountings on posts are the most common. Such antenna mounts have a pivot axis which is parallel to the earth's rotational axis, but have fairly short pivot axes as compared to the diameter of the dish. Such provides limited support. Another complication is the fact that while the satellites in geosynchronous orbit lie in a circular locus on the plane of the equator, when viewed from a position away from the equator, that locus appears to be elliptical, while the axis extending from the center of a polar mounted antenna describes a plane which intersects with that ellipse at only two points. For optimum pointing capability, the polar mount must have its axis adjusted, which further contributes to instability.

Thus, there is need for an inexpensive, reliable, sturdy satellite TV dish antenna support which preferably fits a large number of the dish antennas built by different manufacturers, and which firmly supports the dish on a long pivot axis which is positioned with respect to the dish so that the dish can swing on a path suitable to increase signal reception.

SUMMARY OF THE INVENTION

In order to aid in the understanding of this invention, it can be stated that it is directed to a satellite TV dish antenna support wherein a dish employing the support has a lower mount toward the lower edge of the disk and an upper mount including a declination arm extending behind the disk adjacent its upper edge. The mounts are preferably ball sockets which are supported upon a base, with adjustability to select the inclination angle.

It is an object and advantage of this invention to provide a satellite TV dish antenna support which has a long axis of rotation to support the antenna dish for rotation with little pointing error due to deviations from the axis and to permit adjustment of the tracking path to maximize reception from a plurality of satellites in geostationary synchronous orbits.

It is another object and advantage of this invention to provide a satellite TV dish antenna support which is sufficiently universal to fit most of the dish antennas available, including those without a substantial frame around the ege.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 1 is a side-elevational view of the first preferred embodiment of the satellite TV dish antenna support of this invention, shown supporting a dish antenna.

FIG. 2 is a rear-elevational view, as seen generally along the line 2—2 of FIG. 1.

FIG. 3 is an enlarged back view of the dish, as seen generally along the line 3—3 of FIG. 1.

FIG. 4 is a perspective view of the first preferred embodiment of the TV dish antenna support of this invention, with its dish engagement portion shown separately from a satellite TV dish antenna.

FIG. 5 is a substantially diametrical section through a satellite TV dish antenna showing a second preferred embodiment of the antenna support of this invention.

FIG. 6 is a perspective view taken generally from the rear showing the third preferred embodiment of the satellite TV dish antenna support of this invention, in association with a dish antenna.

FIG. 7 is a left side-elevational view thereof.

FIG. 8 is an exploded enlarged isometric view of the lower pivot of the dish antenna support shown in FIG. 7.

FIG. 9 is an enlarged isometric view of the upper pivot support of the satellite TV dish antenna support shown in FIG. 7.

DESCRIPTION OF THE PREFERRED EMBODIMENTS

All three embodiments of the satellite TV dish antenna support of this invention employ the same base assembly, and thus the base assembly will be first described and will carry the same reference characters in drawings directed to the different embodiments of the satellite TV dish antenna support. Base 10 is a ring which is mounted upon a suitable surface 12 by which the base is secured with respect to the ground. The surface 12 may be a platform, rooftop, foundation or ground providing it is sufficiently firm to be able to provide the proper relationship for the dish antenna support. With respect to the mounting of base 10 on surface 12, it must be remembered that the base will be oriented with respect to the earth's axis and, accordingly, must be firm with respect to the earth in order to maintain this relationship. Legs 14 and 16 are fixed together in an inverted V-shape, secured at their apex. Away from their apex, at the free ends of the legs, they are pivotally attached to ring 10. In FIGS. 1, 2, 6 and 7, boss 18 extends upward next to leg 14 and boss 20 extends up next to leg 16. Pivot pins in the form of rivets or bolts are employed to pivot the legs. One pivot pin extends through aligned openings in leg 14 and boss 18 while another pivot pin extends through aligned openings in leg 16 and boss 20. For shipping purposes, the joined legs can be swung down substantially into the plane of base 10.

At the joined juncture of the legs 14 and 16, a rectangular opening is provided at such a position that elevation rod 22 slidably extends therethrough, and as seen in FIG. 6 in its lower position bisects the angle between the legs 14 and 16. The elevation rod telescopes through its opening in the joined leg structure and is retained at a selected position by means of elevation clamp bolt 24, see FIG. 7. The elevation clamp bolt is threaded into the joined leg structure and extends into the slot in which the elevation rod moves. Thus, by tightening the clamp bolt, the elevation rod is securely joined to the legs at a selected height. As illustrated, base 10 is preferably made of square tubing and can conveniently be in a circular shape approximating that of the diameter of the dish antenna. If desired, the base 10 can be of other configuration, such as a square or rectangular base. The legs and elevation rod are also preferably made of square metallic tube for rigidity, lightness and ease of manufacture.

In order to provide universal support for a dish antenna on the upper end of elevation rod 22, a ball socket therein rotatably carries ball 26. Lower support 28 is secured to base 10 opposite bosses 18 and 20. Preferably it is diametrically opposite in order to achieve equalized loading on the base. Lower support 28 may be a short post secured directly onto base 10 or may be a demountable post, as illustrated in FIGS. 7 and 8. Post 30 has a strap 32 on one or both sides thereof and a clamping bar 34 pivoted on the strap. Jack bolt 36, see FIG. 7, opens the space between the post and the upper part of clamp bar 34 so that the lower part of the clamp bar clamps base ring 10 against post 30. In this way, lower support 28 is demountable, but could be permanently attached if demountability was less desirable. The upper end of lower support 28 carries a ball socket in which lower ball 38 is rotatably mounted.

The first preferred embodiment of that portion of the satellite TV dish antenna support system of this invention which is associated with that base assembly is the dish support generally indicated at 40 in FIGS. 1, 2, 3 and 4. Satellite TV dish antenna 42 is a shallow dish for reflecting and concentrating incoming radiation. The dish antenna has a rim 44 by which the dish is mounted. The rim may be a curled under edge portion of the dish structure or may be a circular member to which the dish is attached. In that event, there is usually a rim portion which is somewhat stronger and heavier than the central part of the dish. Support 40 engages the rim by means of upper yoke 46 and lower yoke 48. Each of the yokes is a mount by which the rim is engaged and supported. The yokes are thus each part of a mounting means. Each of the yokes is bent rod, which may be of circular shape, as is shown in FIG. 4. The yokes are bent into a V-shape and, at the ends of the legs of the V, are bent into hooks. Hooks 50 and 52 are shown in FIG. 4 with respect to yoke 48, and hooks 54 and 56 are shown with respect to upper yoke 46. The hooks are dimensioned so that they can engage around the rim of the TV dish antenna, as shown in FIG. 5. The hooks are also shown engaged around the rim of the dish antenna in FIGS. 1, 2 and 3.

Lower pivot pin strap 58 is secured across the open end of the yoke 40, as by welding to the curved part of the hooks. Lower pivot pin 60 is secured to the strap. Lower pivot pin 60 is is a male bearing member which is sized to fit into the hole through lower ball 38. Upper bar 62 is attached to upper yoke 46 by securing it on the outside of the hooks on the upper yoke. Upper bar 62 carries two features thereon. Cross-sleeve 64 is an open tube which receives the longer leg 66 of polar declination arm 68. Polar declination arm 68 also has a shorter leg 70, which is the upper pivot pin and which is at right angles to the longer leg to form an L-shaped construction. Leg 70 is a male bearing member and is threaded at its outer end. The longer leg is threaded and freely slides through cross sleeve 64. A nut on each end of the sleeve locks the arm at a preselected position. One end of the upper bar 62 extends past the upper yoke and carries thereon stud 72 to which a linear actuator motor can be attached.

Cable 74 is preferably a flexible steel cable and may carry a coating thereon to inhibit abrasion of the cable on adjacent structures. Cable 74 is looped through lower yoke 48 at the apex thereof and is closed in a loop on itself. A conventional malleable or reuseable cable clamp can be employed. The loop is indicated at 76 in FIG. 4, and the clamp is indicated at 78. In similar manner, the other end of cable 74 is formed into a loop 80 by means of clamp 82 which clamps the cable to itself. In this case, clamp 82 is preferably a reuseable clamp so that the overall length of the cable system can be grossly adjusted. Turn buckle 84 has one of its eyes engaged in loop 80 and the other of its eyes engaged at the apex of upper yoke 46. In this way, turn buckle 84 provides fine adjustment of the distance between the hooks on the upper and lower yokes.

In applying the support 40 to the dish antenna 42, the hooks on the yokes are engaged over the rim of the yoke and can diametrically oppose sides, with the hooks facing forward and the yokes and cable around the back of the dish. Turn buckle 84 is close to its maximum length, and cable 74 is tightened by pulling through clamp 82 to achieve a gross adjustment. Turn buckle 84 is thereupon adjusted to obtain the proper cable tension for firm engagement of support 40 onto the dish antenna. It should be noted that with the cable passing around the back of the dish, an increasing tension in the cable causes a forward motion in the bottom of the dish to counteract any increase of dishing which would occur if the two yokes were pulled straight toward each other to squeeze the engaged parts of the rims toward each other. This rear cable thus helps maintain dish shape. With the support 40 properly secured to the dish antenna, the support is placed on the base structure by inserting the lower pivot pin into the hole through lower ball 38 and inserting the shorter leg 70 of the polar declination arm through the hole in upper ball 26. Nuts are applied to secure them in place.

The elevation rod 22 is adjusted in accordance with the latitude of the antenna position on earth. If the pivot axis through the upper and lower ball is perpendicular to the center line axis of the dish, then rotation around the axis would cause the center line to define a plane. By adjustment of the longer leg 66 in its cross sleeve 64 and by application of clamping nuts on each side of the cross sleeve when the proper adjustment is achieved, the dish center line is not perpendicular to the pivot axis. Thus, when the antenna is rotated about the pivot axis, its center line defines the surface of a cone. This conical path of the center line permits the antenna to be better directed successively to a plurality of satellites in geosynchronous equatorial orbit.

When the dish and support are pivotally mounted upon the base assembly, linear motor 94 is attached between stud 72 and a portion of the base assembly. In FIGS. 2 and 3, the leg 14 provides the lower anchoring point for linear motor 94. By energizing linear motor 94, the dish can be rotated on the center line defined by the upper and lower pivot balls 26 and 38 so that the center line of the antenna dish defines the desired conical surface.

The support generally indicated at 86 in FIG. 5 is very similar to the support 40. It has a yoke at each end and a cable 74 connecting therebetween. The yoke 48 with its hooks 50 and 52, strap 58 and pivot pin 60 is the same as that shown in FIG. 4. The upper yoke 88 is the same as yoke 46, including strap 62 and polar declination arm 68. However, yoke 88 is fitted with an angle bracket 90 secured thereto as by welding, and the angle bracket has a hole therethrough in a direction generally bisecting the arms of the yoke. Eyebolt 92 extends through the hole and has an adjusting nut on the yoke side thereof. Loop 80 in cable 74 engages through the eye of the eyebolt to provide continuity between the two yokes. A clamp, the same as clamp 82, permits gross adjustment of the cable with respect to the eyebolt, while the nut on the eyebolt permits fine adjustment of cable tension. Support 86 thus provides a more simple tension adjusting mechanism.

The support 100 illustrated in FIGS. 6 and 7 with details shown in FIGS. 8 and 9 employs the same base assembly 10. The support 100 is particularly suited for a dish antenna 102 which is provided with a strong peripheral ring 104. The ring is preferably a tube of square cross section, formed into a circular ring which serves as the edge of the antenna dish and by which the dish is supported. Such construction is presently common in the commercially available dish antennas. Lower support 106 is generally indicated in FIG. 7 and is illustrated in detail in FIG. 8. It includes a metallic angle structure 108 which has a lower pivot pin 110 secured thereto and extending therefrom. The angle structure is positioned to lie behind the ring 104 and one or more bolts 112 extend through ring 104 and the angle structure to secure lower pivot pin with respect to the dish antenna rim. Lower pivot pin 110 is sized to fit through the hole in lower ball 38.

FIG. 9 is an isometric view of an H-shaped clamp bracket 114 which is formed of two similar clamp bars 116 and 118 which are pivoted with respect to each other by means of side flanges and bolt 120. Extension of jack bolt 122 causes clamping together to the upper jaws of the clamp bar. These are engaged inside and outside of ring 104 at the top thereof, diametrically opposite lower support 106. Cross sleeve 124 is secured to clamp bar 118 and the long leg 66 of polar declination arm 68 is positioned through the sleeve. Nuts on the longer leg on each end of the sleeve clamp the polar declination arm in the selected position. Leg 70 is the pivot pin which extends through upper ball 26, and a nut holds it in place. The ring 104 is sufficiently strong to receive a radially directed bolt 126, see FIG. 6, through the ring for engagement by the linear motor 128. The lower end of the linear motor is secured to the base assembly, such as on leg 16.

Each of the satellite TV dish antenna supports provides a long axis so that as the antenna rotates, its center line defines an accurate cone. Each of the dish antenna supports is universally useable on its class of antenna, with the structure described in FIGS. 6 through 9 useful on those with a strong rim, and those support structures described with respect to FIGS. 1 through 5 are useful for dish antennas without a strong rim so that various styles of sattelite TV dish antennas can be supported and positioned for use at all latitudes. Furthermore, the size of the hooks in the supports of FIGS. 1 through 5 is sufficient so that these supports are useful with all antenna dishes, with varying diameter and varying rim structure, and can be employed to retrofit dish antenna.

This invention has been described in its presently contemplated best mode, and it is clear that it is susceptible to numerous modifications, modes and embodiments within the ability to those skilled in the art and without the exercise of the inventive faculty. Accordingly, the scope of this invention is defined by the scope of the following claims.

What is claimed is:

1. A satellite TV dish antenna support comprising:

a base assembly, said base assembly having a lower ball support thereon and a ball rotatably mounted in said lower ball support, said base assembly also having an upper ball support thereon with an upper ball rotatably mounted in said upper ball support, said upper and lower balls defining a rotation axis for a TV dish antenna, said upper ball support comprising a pair of legs pivotally mounted on said base, said upper ball being telescopically mounted on said legs for adjustment of said ball axis with respect to said base so that the rotation axis can be adjusted with respect to said base;

an upper mount and a lower mount, said upper mount and said lower mount being attachable to a dish antenna which is substantially a curved surface of revolution around a dish axis, said upper mount and said lower mount each comprising a bifurcated yoke having two hooks thereon so that two hooks engage the rim of the dish antenna at each mount and there is a tension cable extending around the back, convex side of the dish antenna and attached to each bifurcated yoke for holding said hooks in place upon the rim of the dish antenna, said upper and lower mounts each respectively carrying a pivot member thereon for respective engagement in said upper and lower balls so that the dish antenna carried on said upper and lower mounts can swing its dish axis by rotation on the rotation axis through said balls.

2. The dish antenna support of claim 1 wherein one of said pivot pins is mounted on each of said yokes.

3. The dish antenna support of claim 2 wherein said cable is adjustable to adjustably retain said hooks on said yokes in engagement with the rim of the dish antenna.

4. The dish antenna support of claim 3 wherein said cable adjustment comprises a turnbuckle engaged between said cable and one of said yokes.

5. The dish antenna support of claim 3 wherein said cable adjustment comprises an eyebolt having its eye engaged by said cable and having its threaded shank engaged by one of said yokes.

6. A satellite TV dish antenna support comprising:

a base assembly, said base assembly having a lower ball support thereon and a ball rotatably mounted in said lower ball support, said base assembly also having an upper ball support thereon and an upper ball rotatably mounted in said upper ball support, said upper and lower balls defining a rotation axis for a TV dish antenna, at least one of said ball supports being adjustable so that the rotation axis can be adjusted with respect to said base;

an upper mount and a lower mount, said upper mount and said lower mount being attachable to a dish antenna which is substantially a curved surface of revolution about a dish axis, said upper mount and said lower mount each comprising a bifurcated yoke having two hooks thereon so that said two hooks can engage the rim of the dish antenna at each mount, a tension cable extending around the back, convex side of the dish antenna and engaged with both yokes for holding said hooks in place on the rim of the dish antenna, said cable being adjustable to adjustably pull said hooks together, said upper and lower mounts each respectively carrying a pivot member thereon for respective engagement in said upper and lower balls so that the dish antenna carried on said upper and lower mounts can swing its dish axis by rotation on the rotation axis through said balls.

7. The dish antenna support of claim 6 wherein one of said pivot pins is mounted on each of said yokes.

8. The dish antenna support of claim 7 wherein said cable is adjustable to adjustably retain said hooks on said yokes in engagement with the rim of the dish antenna.

9. The dish antenna support of claim 8 wherein said cable adjustment comprises a turn buckle engaged between said cable and one of said yokes.

10. The dish antenna support of claim 8 wherein said cable adjustment comprises an eyebolt having its eye engaged by said cable and having its threaded shank engaged by one of said yokes.

11. A satellite TV dish antenna support comprising:

a base assembly, said base assembly having a lower ball support thereon and a ball rotatably mounted in said lower ball support, said base assembly also having an upper ball support thereon with an upper ball rotatably mounted in said upper ball support, said upper and lower balls defining a rotation axis for a TV dish antenna, at least one of said ball supports being adjustable so that the rotation axis can be adjusted with respect to said base;

an upper mount and a lower mount, said upper mount and said lower mount each being shaped to mount directly on the rim of a dish antenna which is substantially a curved surface of revolution about a dish axis, at least one of said mounts is shaped to clamp on the rim and is comprised of first and second clamp bars pivoted with respect to each other and is spaced to clamp on the rim and a jack bolt between said clamp bars to jack apart said clamp bars on one side of their pivot so that they clamp together on the other side of their pivot, one of said clamp bars carrying a pivot pin thereon, said upper and lower mounts each respectively carrying a pivot member thereon for respective engagement in said upper and lower balls so that a dish antenna carried on said upper and lower mounts can swing its dish axis by rotation on the rotation axis through said balls.

12. A satellite TV dish antenna support comprising:

a base;

first and second ball supports on said base, said first ball support being a fixed ball support and a first ball rotatably mounted in said fixed first ball support, said second ball support having at least one leg pivotally mounted on said base and an elevation rod telescopically mounted with respect to said pivotally mounted leg, a second ball rotatably mounted in said second ball support on said telescopic elevation rod so that the rotation axis of a dish antenna through said ball supports can be adjusted with respect to said base;

first and second mounting means for mounting on the periphery of a satellite TV dish antenna which is substantially a surface of revolution about a dish axis, said first and second mounting means mounting on the periphery of a satellite TV dish antenna at substantially opposite sides thereof, each of said first and second mounting means comprising a V-shaped yoke having a hook on the outer end thereof, with said hooks configured to engage around the periphery of the dish antenna said first and second mounting means each carrying a pivot pin thereon, said pivot pins being mounted on one of said yokes and a cable connected between said yokes for extending around the convex bottom of the antenna dish to urge said yokes toward each other and clamp them on the periphery of the dish antenna, each said pivot pin being pivotable in its ball so that said TV dish antenna pivots on a rotation axis through said balls to swing the dish axis, at least one of said pivot pins being adjustable with respect to its mounting means so as to adjust the cone angle of sweep of the axis of the dish.

13. The TV dish antenna support of claim 12 wherein said cable is adjustable with respect to at least one of said yokes to control the clamping force of said yokes upon the antenna dish.

* * * * *